US006505493B2

(12) United States Patent
Nakane et al.

(10) Patent No.: US 6,505,493 B2
(45) Date of Patent: Jan. 14, 2003

(54) SUPPORT BAR AND METHOD FOR FORMING A SUPPORT BAR

(75) Inventors: Hidetoshi Nakane, Toyota (JP); Nobuhiko Takeda, Aichi-ken (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 22 days.

(21) Appl. No.: 09/790,644

(22) Filed: Feb. 23, 2001

(65) Prior Publication Data

US 2002/0000032 A1 Jan. 3, 2002

(30) Foreign Application Priority Data

Feb. 29, 2000 (JP) ..... 2000-054235

(51) Int. Cl.[7] ..... B21D 22/02
(52) U.S. Cl. ..... 72/370.21; 74/457; 72/370.04
(58) Field of Search ..... 72/370.04, 370.17, 72/370.21; 74/422, 457, 540; 254/112

(56) References Cited

U.S. PATENT DOCUMENTS 2,825,962 A * 3/1958 Brown et al. ..... 72/370.21
6,170,313 B1 * 1/2001 Vasseur et al. ..... 72/370.21

FOREIGN PATENT DOCUMENTS

JP 61-232022 * 10/1986 ..... 72/FOR 101
JP 8-90125 4/1996
JP 8-90126 4/1996
JP 2510902 6/1996

* cited by examiner

*Primary Examiner*—Lowell A. Larson
(74) *Attorney, Agent, or Firm*—Burns, Doane Swecker & Mathis, LLP

(57) ABSTRACT

A support bar of a headrest assembly or a hand brake is provided with one or more notches or indented portions. The notches or indented portions are formed in a way that inhibits the formation of additional material portions extending outwardly from the smoothly curved outer surface of the support bar. The indented portions or notches possess a shape having continuous curvature as seen in a cross-section perpendicular to the axis of the pipe member.

10 Claims, 6 Drawing Sheets

SUPPORT BAR AND METHOD FOR FORMING A SUPPORT BAR

This application is based on and claims priority under 35 U.S.C. § 119 with respect to Japanese Application No. 2000-054235 filed on Feb. 29, 2000, the entire content of which is incorporated herein by reference.

FIELD OF THE INVENTION

The present invention generally relates to a support bar and method of forming a support bar. More particularly, the present invention pertains to a support bar used in a headrest assembly for supporting the headrest in its adjusted position, or used in a hand brake for maintaining an operated position of the hand brake by engaging the support bar with a hand brake ratchet, as well as a method for forming such a support bar.

BACKGROUND OF THE INVENTION

A known type of support bar and method for forming such a support bar is disclosed in Japanese Patent Application Publication published as Toku-Kai-Hei 8(1996)-90125. FIG. 7 illustrates the method disclosed in this publication for forming a dent or notch on the outer peripheral portion of a hollow pipe member that serves as an engagement mechanism allowing the pipe member to serve as a support bar. In the disclosed method, the hollow pipe is fixed by a die device having lower and upper die parts. A punch 92 movable through the upper die part presses against the outer periphery of the pipe member in the radial direction of the pipe member to form the dent or notch. To take into account possible variations in the outer diameter of the pipe, the inner diameter of the die parts of the die device must be slightly larger than the outer diameter of the pipe to prevent the pipe member from being clinched or seized in the die parts.

However, because of this difference in diameter, it occasionally happens that the pipe member cannot be properly fixed by the die parts of the die device. When the pipe member is not firmly fixed by the die device and the forming surface on the top of the punch is concave, the unstable nature of the pipe member during the notch forming process results in the formation of unwanted additional material portions 91 (burr-like projections) that extend or expand outwardly beyond the generally smoothly curved outer periphery of the pipe member and at the side end parts of the notch or indented portion as shown in FIGS. 8 and 9. These additional material portions 91 may also be generated when the surface of the punch is flat as shown in FIG. 9.

In the case of, for example, a headrest assembly, because the support bar is slidably supported through a guide member that is attached on the vehicle seat, these additional material portions may interfere with the smooth sliding movement of the support bar in the guide member. As a result, it is necessary to implement additional processing steps to remove these additional material portions 91 and this undesirably increases the manufacturing costs.

In light of the foregoing, a need exists for a support bar and method of manufacturing a support bar that is not as susceptible to the formation of additional material portions extending outwardly beyond the smoothly curved outer periphery of the support bar.

SUMMARY OF THE INVENTION

According to one aspect of the invention, a support bar includes an elongated pipe member provided with at least indented portion formed on the outer peripheral surface of the pipe member by press stamping. The indented portion has a bottom surface portion possessing a continuous concave curvature as seen in a cross-section perpendicular to the longitudinal axis of the pipe member.

According to another aspect of the invention, a support bar includes an elongated pipe member provided with at least press-stamped indented portion on the outer peripheral surface of the pipe member. The indented surface portion has an inclined surface portion that is inclined relative to the longitudinal axis of the pipe member. The inclined surface portion possesses a concave curvature as seen in a cross-section perpendicular to the longitudinal axis of the pipe member.

Another aspect of the present invention involves a method for making a support bar. The method includes fixing a pipe member in a die device having at least three die parts so that the pipe member is positioned parallel to the die parts and with the die device encircling a portion of the outer peripheral surface of the pipe member. A punch is inserted into a through hole formed in the die device and towards the outer peripheral surface of the pipe member. The punch has a convexly shaped free end surface facing the outer peripheral surface of the pipe member as the punch is inserted into the through hole. The free end surface of the punch is pressed against the outer peripheral surface of the pipe member to form an indented portion on the outer peripheral surface of the pipe member.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements and wherein.

DETAILED DESCRIPTION OF THE INVENTION

Figure 1:
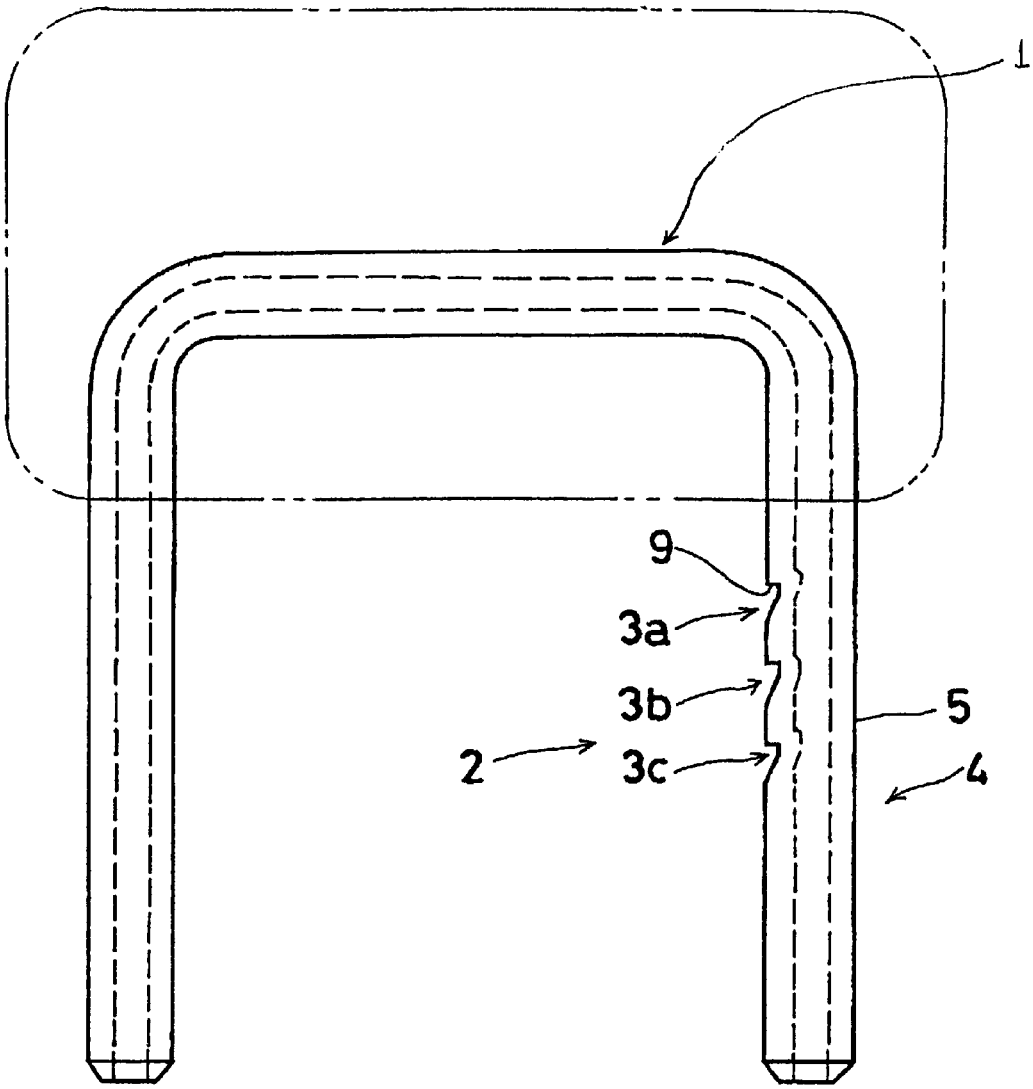
FIG. 1 is a plan view of a support bar according to the present invention that is adapted to be used with a headrest in a vehicle headrest assembly.
Figure 10:
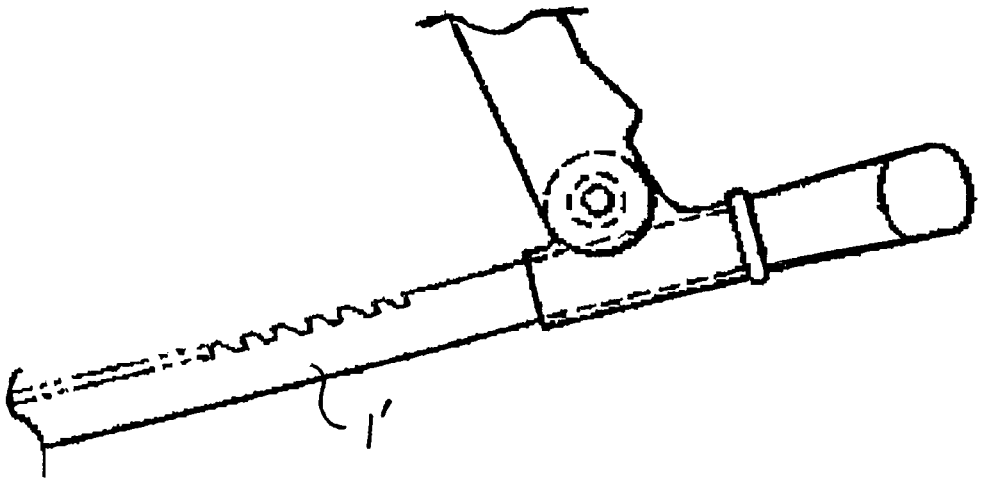
FIG. 10 is a plan view of a hand brake with support bar ratchet in accordance with the present invention.

Referring initially to FIG. 1, the vehicle seat headrest support bar 1 that is adapted to be used in a vehicle headrest assembly is formed from a hollow tube 2 possessing a generally upside-down U-shaped configuration having two vertical straight portions and a horizontal straight portion connecting together the two vertical straight portions. The pad forming a part of the headrest assembly is depicted in FIG. 1 in dotted outline form. One of the straight portions of the support bar 1 forming a pipe member 4 is provided with a plurality of indented portions or notches 3*a*, 3*b*, 3*c*. The notches 3*a*, 3*b*, 3*c* are formed in series and are spaced apart from one another along the length of the pipe member 4. These notches or indented portions 3*a*, 3*b*, 3*c*, are adapted to engage a ratchet member attached to the vehicle seat (not shown) and forming a part of the headrest assembly. The support bar with the notches formed by the process according to this invention is applicable not only to support bars used in vehicle seat headrest assemblies, but also to any support bar or similar structure requiring a notch or indented portion, such as the support bar 1' of a hand brake device as shown in FIG. 10.

Figure 2:
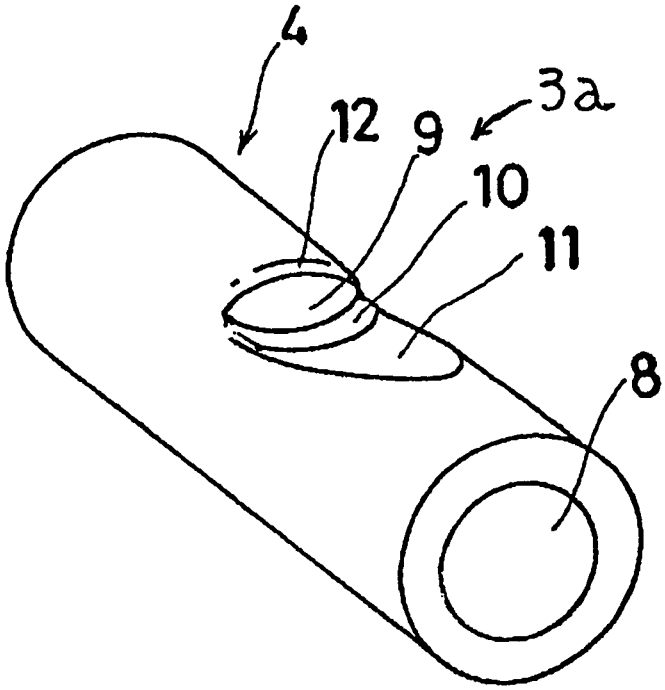
FIG. 2 is an enlarged perspective view of a portion of the support bar shown in FIG. 1 illustrating one dent or notch portion formed on the support bar.
Figure 3:
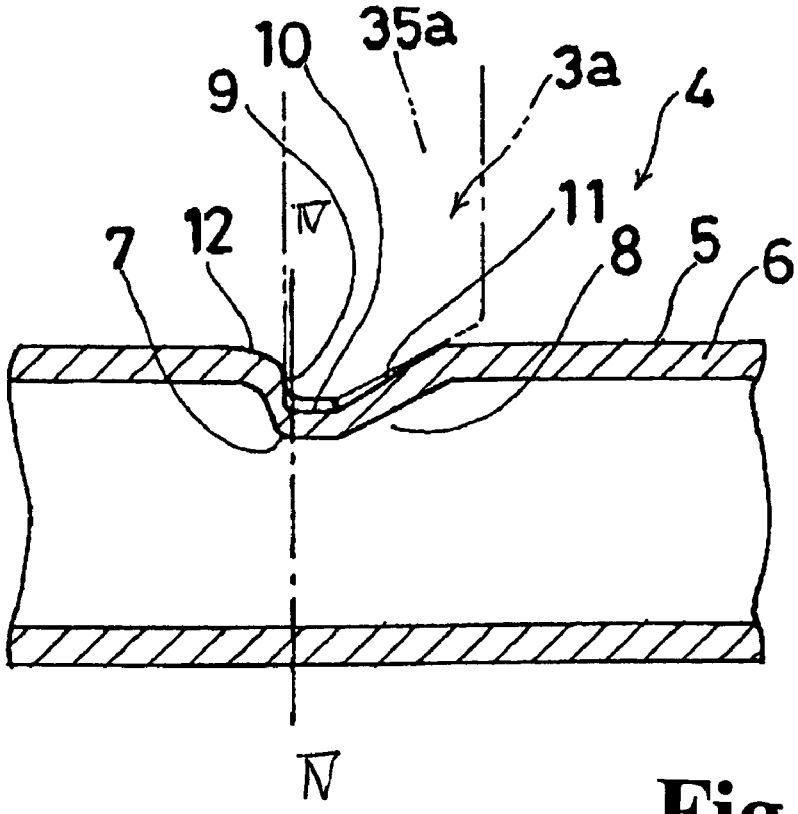
FIG. 3 is a longitudinal cross-sectional view of the portion of the support bar shown in FIG. 2.
Figure 4:
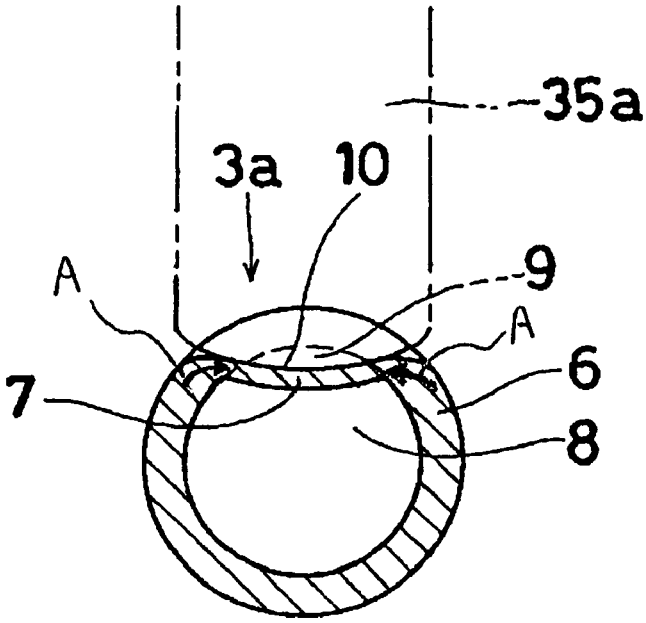
FIG. 4 is a cross-sectional view of the support bar taken along the section line IV—IV of FIG.3.

One of the notches or indented portions 3*a* shown in FIG. 1 is illustrated in more detail in FIGS. 2, 3 and 4 to help facilitate an understanding of the structure of the support bar and the way in which the support bar is manufactured. It is to be understood that all of the notches 35*a*, 35*b*, 35*c* preferably possess the same configuration as that shown in the drawing figures.

Generally speaking, in the case of a support bar used in a headrest assembly, the notch or indented portion 3*a* is used as an element of a ratchet mechanism that allows the height of the headrest to be adjusted. When used in other contexts, the notches or the indented portions provide similar adjustability such as in the case of a hand brake mechanism in which the hand brake is set at different positions.

As shown in FIGS. 2 and 3, the indented portion or notch 3*a* includes an upright surface portion 9 formed at one axial end of the notch. This upright surface portion 9 extends in the radial direction of the pipe member 4 (i.e., is perpendicular to the axis of the pipe member 4 as seen in the longitudinal cross-section of the pipe member 4). The notch or indented portion 3*a* also includes an inclined surface portion 11. This inclined surface portion 11 extends at an angle in the axial direction of the pipe member 4 (i.e., is other than parallel or perpendicular to the axis of the pipe member 4 as seen in the longitudinal cross-section of the pipe member 4). In addition, the notch 3*a* includes a bottom surface portion 10 formed between and connecting the upright surface portion 9 and the inclined surface portion 11. The bottom surface portion is parallel to the axis of the pipe member 4 as seen in the longitudinal cross-section of the pipe member 4.

FIG. 4 is a cross-sectional illustration of the bottom surface portion 10 of the notch. The cross-section shown in FIG. 4 is taken along a section line (section plane) that is perpendicular to the axis of the pipe member 4. As seen in FIG. 4, the bottom surface portion 10 of the notch 3*a* in the cross-section perpendicular to the axis of the pipe member 4 possesses a smooth and continuous concave curvature. The bottom surface portion 10 of the notch or indented portion 3*a* is thus concavely curved from the outer periphery of the pipe member towards the center of the pipe member as seen in a cross-section perpendicular to the axis of the pipe member as depicted in FIG. 4. On the other hand, as seen in FIG. 3, the bottom surface portion 10 of the notch 3*a* is flat with respect to the longitudinal cross-section parallel to the axis of the pipe member 4.

As generally seen in FIG. 2, the shape of the inclined surface portion 11 in a cross-section perpendicular to the axis of the pipe member is similar to that of the bottom surface portion. Thus, the inclined surface portion 11 is also formed as a smooth and continuous concave surface as seen in a cross-section perpendicular to the axis of the pipe member 4.

A wall portion 7 of the bottom surface portion 10 is formed by virtue of plastic flow of the pipe material from the wall portion 6 of the outer periphery 5 of the pipe member 4. A part of the wall portion 6 is sunk inwardly or is pressed inwardly toward the hollow portion 8 of the pipe member 4 by pressing a punch 35*a* on the outer periphery 5 of the pipe member 4. Further, upon forming the notch or indented portion 3*a*, a shear droop 12 on the outer surface of the pipe member 4 is formed adjacent to the upright surface portion 9 because a part of the wall portion 6 of the outer periphery 5 is caused to move towards the notch or indented portion 3*a* by plastic flow of the material forming the wall portion 6. The dimensions of the indented portion or notch 3*a* are adjusted or selected to minimize the amount of the shear drop 12 and thereby ensure an adequate upright surface portion 9.

Figure 5:
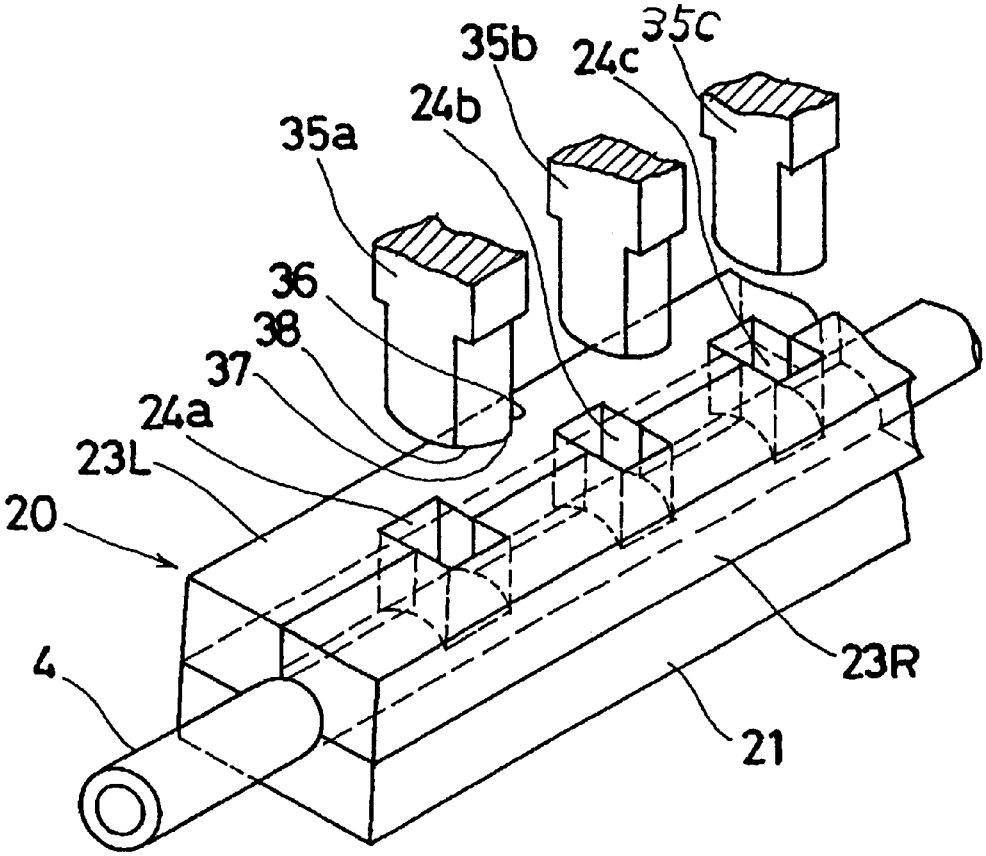
FIG. 5 is a perspective view of a press die device according to the present invention used to form the support bar of the present invention.
Figure 6:
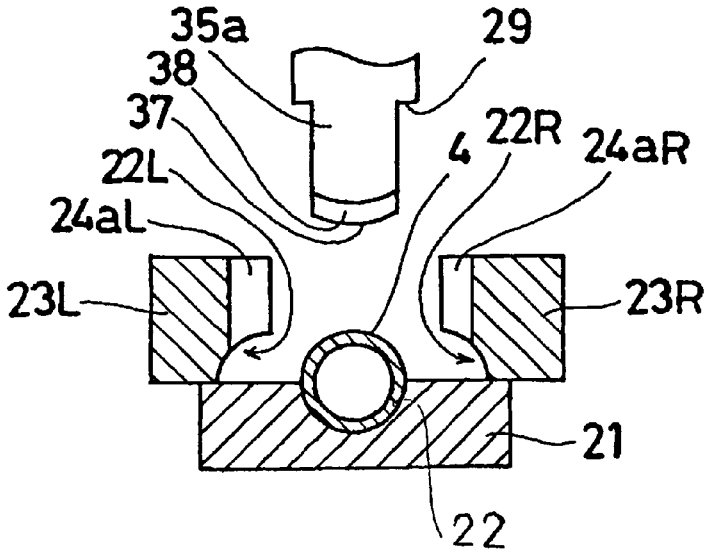
FIG. 6 is a cross-sectional view of the press die device shown in FIG. 5.
Figure 7:
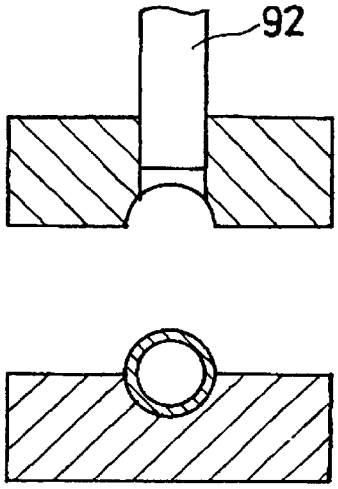
FIG. 7 is a cross-sectional view of the known press die device used to press form the dent or notch portion of a support bar of a headrest.

Referring to FIGS. 5 and 6, the method for forming the support bar and the manufacturing apparatus used to fabricate the support bar 1 are as follows. The pipe member 4 formed of raw material is fixed by a die device 20 for receiving a load during the press forming process. The die device 20 includes a lower die part 21, an upper right die part 23R, and an upper left die part 23L. A groove 22 is provided on the lower die part 21 to receive the pipe member 4 so that the lower half of the pipe member 4 is situated in the groove 22. A groove 22R is also formed in the upper right die part 23R while a groove 22L is provided in the upper left die part 23L. These grooves 22R, 22L cover the right and left upper half of the pipe member 4 respectively.

As shown in FIG. 6, the pipe member 4 is disposed in the groove 22 of the lower die part 21. Then the upper part of the pipe member 4 is caused to be held between the upper right die part 23R and the upper left die part 23L by horizontally sliding the two upper die parts 23R, 23L from opposite sides to fix the pipe member 4 in the grooves 22R, 22L. The die parts 21, 23R, 23L are thus positioned parallel to the pipe member 4.

The upper die parts 23R, 23L are preferably designed so that a clearance exists in the central section between the upper right die part 23R and the upper left die part 23L when the pipe member 4 is fixed between the upper right die part 23R and the upper left die part 23L. It is thus possible to fix the pipe member 4 firmly in the grooves 22R, 22L regardless of minor variations in the outer diameter of the pipe member 4.

As illustrated in FIG. 5, a plurality of through holes 24*a*, 24*b*, 24*c* are provided in the die device at the central section between the upper right die part 23R and the upper left die part 23L. The through holes 24*a*, 24*b*, 24*c* open to the upper surface of the die device and also open to the inner surface of the upper die parts 23R, 23L The through holes 24*a*, 24*b*, 24*c* thus extend from the upper surface of the die device to the outer surface of the pipe member 4 which is fixed in the grooves 22, 22R, 22L. Each of the through holes 24*a*, 24*b*, 24*c* is adapted to receive a respective punch 35*a*, 35*b*, 35*c* for press forming the notches in the outer surface of the pipe member 4. The press device that operates the punches 35*a*, 35*b*, 35*c* is designed to move the punches so that the ends of the punches 35*a*, 35*b*, 35*c* are able to reach or contact the outer periphery 5 of the pipe member 4 and then press against the outer periphery of the pipe member.

As shown in FIG. 6, the end of each punch 35*a*, 35*b*, 35*c* is shaped and configured to produce the specific shape and configuration of the respective indented portions or notches 3*a*, 3*b*, 3*c* described above. In this embodiment, the shape of the free end of each of the punches 35*a*, 35*b*, 35*c* is the same. The end of each punch 35*a*, 35*b*, 35*c* that is adapted to press against the outer periphery of the pipe member 4 includes a front surface or forwardly facing upright surface that constitutes an upright portion forming surface 36 for forming the upright surface portion 9 of the respective notch. A part of the free end surface of each punch 35*a*, 35*b*, 35*c* adjacent the upright portion forming surface 36 and extending partially away from the upright portion forming surface 36 constitutes the bottom portion forming surface 37 for forming the bottom surface portion of the respective notch. The remainder of the free end surface of each notch extending away from the bottom portion forming surface 37 constitutes the inclined portion forming surface 38 for forming the inclined surface portion 11 of the respective notch. As seen in FIG. 6, the bottom portion forming surface 37 and the inclined portion forming surface 38 of each punch possess a smoothly and continuously curved convex shape for forming the continuously curved concave shape of the bottom surface portion 10 and the inclined surface portion 11 of the notch or indented portion as shown in FIGS. 2 and 4.

Figure 8:
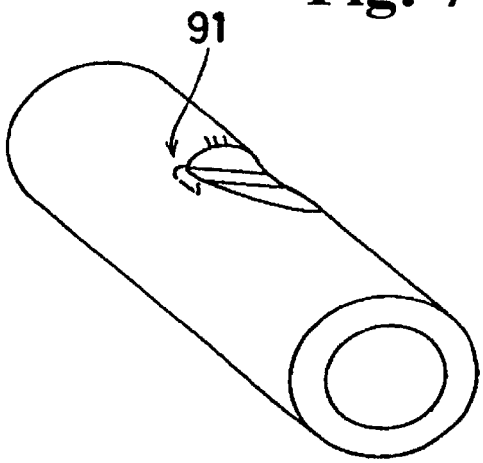
FIG. 8 is a perspective view of a portion of the support bar produced using the press die device shown in FIG. 7.
Figure 9:
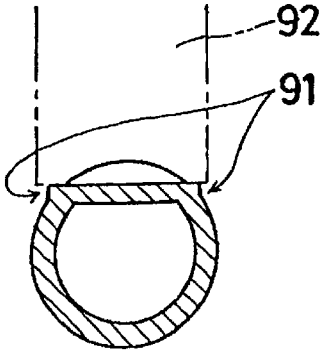
FIG. 9 is a cross-sectional view of the support bar shown in FIG. 8 illustrating the dent or notch portion of the support bar.

When the punches 35*a*, 35*b*, 35*c* are pressed against the outer periphery 5 of the pipe member 4, the central region of the bottom portion forming surfaces 37 of the punches 35*a*, 35*b*, 35*c* first come into contact with the center region of the outer periphery (outer peripheral surface) of the pipe member 4. The bottom surface portion 10 of each notch 3*a*, 3*b*, 3*c* thus begins to take form. The depth of the notches or indented portions 3*a*, 3*b*, 3*c* gradually increases in the radial direction as the punches 35*a*, 35*b*, 35*c* are further pressed against the outer periphery of the pipe member. As this occurs, the bottom surface portion 10 of each notch 3*a*, 3*b*, 3*c* continues to form and the inclined surface portion 11 of each notch 3*a*, 3*b*, 3*c* begins to form. The plastic flow of the material 6 indicated by the small arrows A in FIG. 4 is also produced. Therefore, it is possible with the present invention to avoid the formation of additional portions of the pipe member 4 extending outwardly beyond the width dimension of the notches 3*a*, 3*b*, 3*c* such as occurred in the case of other known support bars produced by the known method described above. Further, the pipe member 4 is pressed between the upper die parts 23R, 23L and so the circular shape of the outer periphery of the pipe member 4 is maintained. Also the pipe member 4 is firmly fixed by the press die device 20 during the manufacturing process and so the position of the pipe member 4 is firmly held relative to the punches 35*a*, 35*b*, 35*c*. Stable plastic flow of the material forming the pipe member is thus produced. Accordingly, the occurrence of the additional portion described above and shown in FIGS. 8 and 9 is prevented.

In addition, the punches 35*a*, 35*b*, 35*c* advantageously possess stepped portions 29 which control or restrict the pushing or advancing stroke of the punches 35*a*, 35*b*, 35*c*.

Thus, with the present invention, the plastic material flow of the wall portion 6 indicated by the small arrows A in FIG. 4 is produced by the pressing force toward the hollow interior 8 of the pipe member 4. The indented portions or notches 3*a*, 3*b*, 3*c* are formed in a stable manner without producing additional material portions extending outwardly beyond the smoothly curved outer periphery 5 of the pipe member 4. The smooth circular profile and constant outer diameter of the pipe member 4 are thus maintained over the entire length of the pipe member 4 by virtue of the method of the present invention. It is thus possible to produce a support bar that is capable of effecting smooth sliding movement during use while also possessing a smooth outer appearance. Also, the strength of the support bar 1 is not reduced at the notches or indented portions 3*a*, 3*b*, and 3*c* because the wall portion 6 of the pipe member is not cut away to form the notches or dent portions 35*a*, 35*b*, 35*c* as is the case with other known machining formation methods. The plastic material flow generated by the forming process of the present invention creates material hardening effects with respect to the pipe member 4, and this imparts increased strength to the pipe member 4.

As noted above, the notches or indented portions of the support bar 1 for a headrest or a hand brake can be advantageously press-formed press-stamped in accordance with the present invention substantially without producing any additional material portions extending outwardly beyond the outer periphery of the pipe member.

The principles, preferred embodiment and method of manufacture of the present invention have been described in the foregoing specification. However, the invention which is intended to be protected is not to be construed as limited to the particular embodiment disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What we claim is:

1. A support bar comprising:

an elongated pipe member having an outer peripheral surface and a longitudinal axis; and at least one indented portion formed on the outer peripheral surface of the pipe member by press stamping, the indented portion including a bottom surface portion possessing a continuous concave curvature as seen in a cross-section perpendicular to the longitudinal axis of the pipe member and an radially extending upright surface portion.

2. The support bar as set forth in claim 1, wherein the radially extending upright surface portion is positioned at one axial end of the indented portion.

3. The support bar as set forth in claim 1, including a plurality of indented portions formed along the outer peripheral surface of the pipe member, each of the indented portions being identically configured.

4. A support bar comprising:

an elongated pipe member having an outer peripheral surface and a longitudinal axis; and at least one press-stamped indented portion on the outer peripheral surface of the pipe member, the indented surface portion including a radially extending upright surface portion and an inclined surface portion that is inclined relative to the longitudinal axis of the pipe member, the inclined surface portion possessing a concave curvature as seen in a cross-section perpendicular to the longitudinal axis of the pipe member.

5. The support bar as set forth in claim 4, wherein the radially extending upright surface portion is positioned at one axial end of the indented portion.

6. The support bar as set forth in claim 4, including a plurality of indented portions formed along the outer peripheral surface of the pipe member, each of the indented portions being identically configured.

7. A support bar comprising:

an elongated hollow tube having an outer peripheral surface and a longitudinal axis, the hollow tube having an upside down U-shaped configuration including two leg portions connected by a connecting portion; and at least one press-stamped indented portion formed on an outer peripheral surface of one of the leg portions of the tube, the indented portion including an upright surface portion that is perpendicular to a longitudinal axis of the one leg portion and a bottom surface portion possessing a continuous concave curvature as seen in a cross-section perpendicular to the longitudinal axis of the one leg portion.

8. The support bar as set forth in claim 7, wherein the radially extending upright surface portion is positioned at one axial end of the indented portion.

9. The support bar as set forth in claim 7, including a plurality of indented portions formed along the outer peripheral surface of the one leg portion of the tube, each of the indented portions being identically configured.

10. The support bar as set forth in claim 7, wherein the support bar forms a part of a headrest assembly including a pad, with the connecting portion of the tube being adapted to support the pad.

* * * * *